US005878989A

United States Patent [19]

Allman

[11] Patent Number: 5,878,989

[45] Date of Patent: Mar. 9, 1999

[54] ROTATING TREE STAND

[76] Inventor: Galen Paul Allman, 914 Chambers St., Harrisburg, Pa. 17113

[21] Appl. No.: 842,914

[22] Filed: Apr. 17, 1997

[51] Int. Cl.[6] ..... F16M 13/00

[52] U.S. Cl. ..... 248/522; 248/349.1; 211/163

[58] Field of Search ..... 248/349.1, 519, 248/521, 522, 523, 550

[56] References Cited

U.S. PATENT DOCUMENTS

| | | | |
|---|---|---|---|
| 1,921,614 | 8/1933 | Frei, Jr. | 248/519 |
| 2,005,293 | 6/1935 | Harris et al. | 248/522 |
| 2,469,884 | 5/1949 | Masone | 248/521 |
| 2,485,460 | 10/1949 | Rocco | 248/522 |
| 2,487,235 | 11/1949 | Goss | 248/519 |
| 2,847,175 | 8/1958 | Farley et al. | 248/522 |
| 4,625,938 | 12/1986 | Brown | 248/550 |
| 5,190,261 | 3/1993 | Tetting | 248/522 |

*Primary Examiner*—Ramon O. Ramirez
*Assistant Examiner*—Robert Lipcsik

[57] ABSTRACT

A new Rotating Tree Stand for providing the ability to rotate a Christmas tree through 360 degrees thus allowing the entire tree to be accessible for decorating and display. The inventive device includes a stationary base member and a rotatable shell member shrouding the stationary base member, wherein the rotatable shell member is rotatable relative to the stationary base member and is adapted to support a Christmas tree. A rotation unit is provided for rotating the rotatable shell member relative to the stationary base member and a musical unit is provided for playing songs, wherein the rotation unit and the musical unit are shrouded by the rotatable shell member. A remote electrical outlet is provided in the rotatable shell member for providing electrical power to an electrical adornment placed on the Christmas tree, such as a string of lights, and a remote control is provided for controlling the operation of the Rotating Tree Stand.

1 Claim, 5 Drawing Sheets

ROTATING TREE STAND

BACKGROUND OF THE INVENTION

1. Field of the Invention

The present invention relates to Christmas tree stands and more particularly pertains to a new Rotating Tree Stand for providing the ability to rotate a Christmas tree through 360 degrees thus allowing the entire tree to be accessible for decorating and display.

2. Description of the Prior Art

The use of Christmas tree stands is known in the prior art. More specifically, Christmas tree stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art Christmas tree stands include U.S. Pat. No. 5,388,799; U.S. Pat. No. 5,299,381; U.S. Pat. No. 4,156,323; U.S. Pat. No. D359,462; U.S. Pat. No. 5,290,004; and U.S. Pat. No. 5,054,622.

While these devices fulfill their respective, particular objectives and requirements, the aforementioned patents do not disclose a new Rotating Tree Stand. The inventive device includes a stationary base member and a rotatable shell member shrouding the stationary base member, wherein the rotatable shell member is rotatable relative to the stationary base member and is adapted to support a Christmas tree. A rotation unit is provided for rotating the rotatable shell member relative to the stationary base member and a musical unit is provided for playing songs, wherein the rotation unit and the musical unit are shrouded by the rotatable shell member. A remote electrical outlet is provided in the rotatable shell member for providing electrical power to an electrical adornment placed on the Christmas tree, such as a string of lights, and a remote control is provided for controlling the operation of the Rotating Tree Stand.

In these respects, the Rotating Tree Stand according to the present invention substantially departs from the conventional concepts and designs of the prior art, and in so doing provides an apparatus primarily developed for the purpose of providing the ability to rotate a Christmas tree through 360 degrees thus allowing the entire tree to be accessible for decorating and display.

SUMMARY OF THE INVENTION

In view of the foregoing disadvantages inherent in the known types of Christmas tree stands now present in the prior art, the present invention provides a new Rotating Tree Stand construction wherein the same can be utilized for providing the ability to rotate a Christmas tree through 360 degrees thus allowing the entire tree to be accessible for decorating and display.

The general purpose of the present invention, which will be described subsequently in greater detail, is to provide a new Rotating Tree Stand apparatus and method which has many of the advantages of the Christmas tree stands mentioned heretofore and many novel features that result in a new Rotating Tree Stand which is not anticipated, rendered obvious, suggested, or even implied by any of the prior art Christmas tree stands, either alone or in any combination thereof.

To attain this, the present invention generally comprises a stationary base member and a rotatable shell member shrouding the stationary base member, wherein the rotatable shell member is rotatable relative to the stationary base member and is adapted to support a Christmas tree. A rotation unit is provided for rotating the rotatable shell member relative to the stationary base member and a musical unit is provided for playing songs, wherein the rotation unit and the musical unit are shrouded by the rotatable shell member. A remote electrical outlet is provided in the rotatable shell member for providing electrical power to an electrical adornment placed on the Christmas tree, such as a string of lights, and a remote control is provided for controlling the operation of the Rotating Tree Stand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Rotating Tree Stand apparatus and method which has many of the advantages of the Christmas tree stands mentioned heretofore and many novel features that result in a new Rotating Tree Stand which is not anticipated, rendered obvious, suggested, or even implied by any of the prior art Christmas tree stands, either alone or in any combination thereof.

It is another object of the present invention to provide a new Rotating Tree Stand which may be easily and efficiently manufactured and marketed.

It is a further object of the present invention to provide a new Rotating Tree Stand which is of a durable and reliable construction.

An even further object of the present invention is to provide a new Rotating Tree Stand which is susceptible of a low cost of manufacture with regard to both materials and labor, and which accordingly is then susceptible of low prices of sale to the consuming public, thereby making such Rotating Tree Stand economically available to the buying public.

Still yet another object of the present invention is to provide a new Rotating Tree Stand which provides in the apparatuses and methods of the prior art some of the advantages thereof, while simultaneously overcoming some of the disadvantages normally associated therewith.

Still another object of the present invention is to provide a new Rotating Tree Stand for providing the ability to rotate a Christmas tree through 360 degrees thus allowing the entire tree to be accessible for decorating and display.

Yet another object of the present invention is to provide a new Rotating Tree Stand which includes a stationary base member and a rotatable shell member shrouding the stationary base member, wherein the rotatable shell member is rotatable relative to the stationary base member and is adapted to support a Christmas tree. A rotation unit is provided for rotating the rotatable shell member relative to the stationary base member and a musical unit is provided for playing songs, wherein the rotation unit and the musical unit are shrouded by the rotatable shell member. A remote electrical outlet is provided in the rotatable shell member for providing electrical power to an electrical adornment placed on the Christmas tree, such as a string of lights, and a remote control is provided for controlling the operation of the Rotating Tree Stand.

Still yet another object of the present invention is to provide a new Rotating Tree Stand that includes a safety shut-off which would stop rotation of the tree if an object were to interfere with the tree while rotating.

Even still another object of the present invention is to provide a new Rotating Tree Stand that includes a luminescent base member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
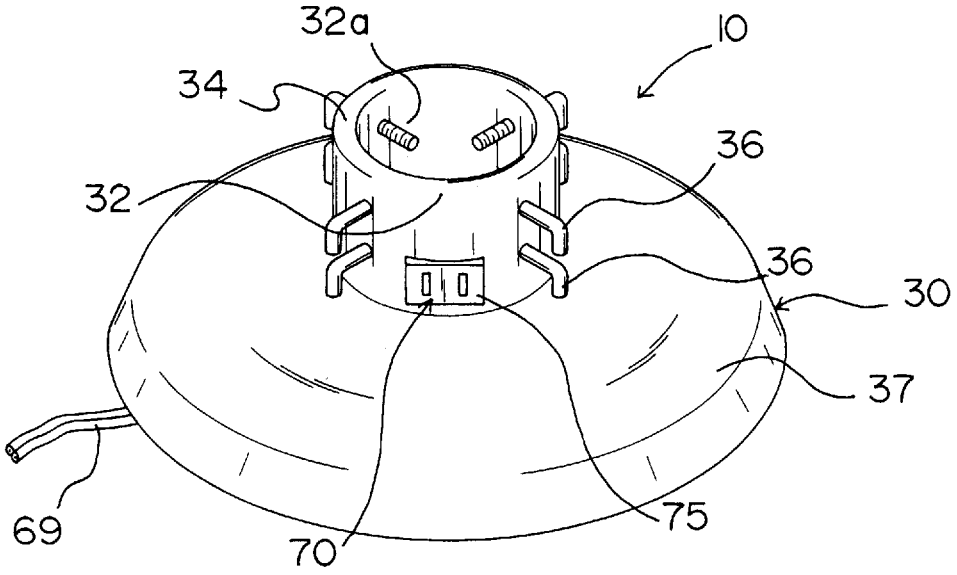
FIG. 1 is an illustration of a new Rotating Tree Stand according to the present invention.
Figure 2:
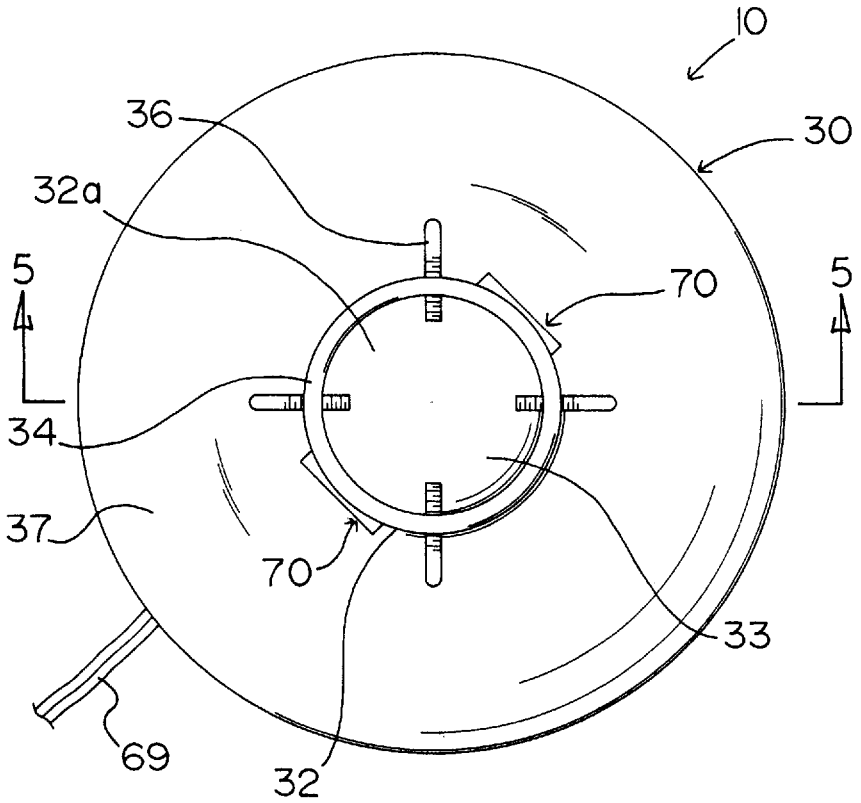
FIG. 2 is a top view of the present invention.
Figure 3:
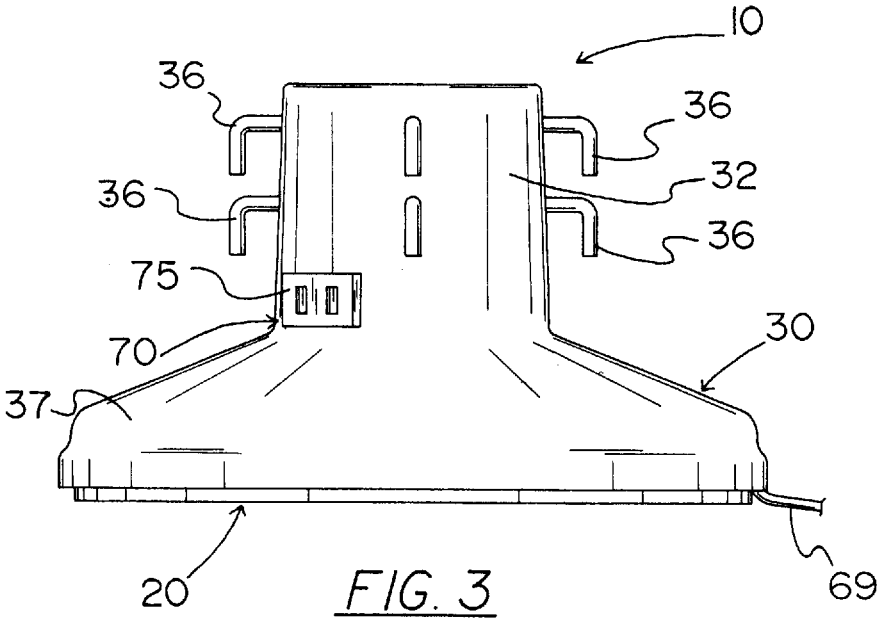
FIG. 3 is a side view of the present invention.

With reference now to the drawings, and in particular to FIGS. 1 through 9 thereof, a new Rotating Tree Stand embodying the principles and concepts of the present invention and generally designated by the reference numeral 10 will be described.

More specifically, it will be noted that the Rotating Tree Stand 10 comprises a stationary base member 20 and a rotatable shell member 30 shrouding the stationary base member 20, wherein the rotatable shell member 30 is rotatable relative to the stationary base member 20 and is adapted to support a Christmas tree (not shown). A rotation unit 40 is provided for rotating the rotatable shell member 30 relative to the stationary base member 20 and a musical unit 50 is provided for playing songs, wherein the rotation unit 40 and the musical unit 50 are shrouded by the rotatable shell member 30. A remote electrical outlet 70 is provided in the rotatable shell member 30 for providing electrical power to an electrical adornment placed on the Christmas tree, such as a string of lights, and a remote control 80 is provided for controlling the operation of the Rotating Tree Stand 10.

As best illustrated in FIGS. 1 through 6, it can be shown that the rotatable shell member 30 is circular in shape and has an inner surface 30*a*. The rotatable shell member 30 includes a tree support portion 32 and a shroud portion 37 extending radially from the tree support portion 32. The tree support portion 32 comprises a base 33 and a circular wall 34 extending upward from the base 33, wherein the base 33 and the circular wall 34 define a water-tight, circular cavity 32*a* adapted to receive a trunk of a Christmas tree. The circular wall 34 has a plurality of threaded holes 35 therethrough and a plurality of threaded clamping members 36 are threadingly fitted within the plurality of threaded holes 35 whereby the plurality of threaded clamping members 36 are threaded towards the trunk of the Christmas tree to secure the Christmas tree within the water-tight, circular cavity 32*a*. A lip 34*a* is provided along the inner periphery of the circular wall 34 opposite the base 33.

An annular contact plate 31 is provided on the inner surface 30*a* of the rotatable shell member. A positive electrical contact track 78 and a negative electrical contact track 79 are provided on the annular contact plate 31 such that the positive electrical contact track 78 and the negative electrical contact track 79 are concentrically spaced. The inner surface 30*a* has a shaft receiving hole 38 and a circular roller groove 39 therein. The shaft receiving hole 38 is provided along a central axis of the rotatable shell member 30 and the circular roller groove 39 is provided along the inner periphery of the rotatable shell member 30.

The stationary base member 20 is circular in shape. The stationary base member 20 may be formed of a translucent or luminescent material and a light source (not shown) may be positioned in a hole (not shown) provided in the stationary base member 20 whereby the light source illuminates the stationary base member 20. As such, the stationary base member 20 glows.

Figure 4:
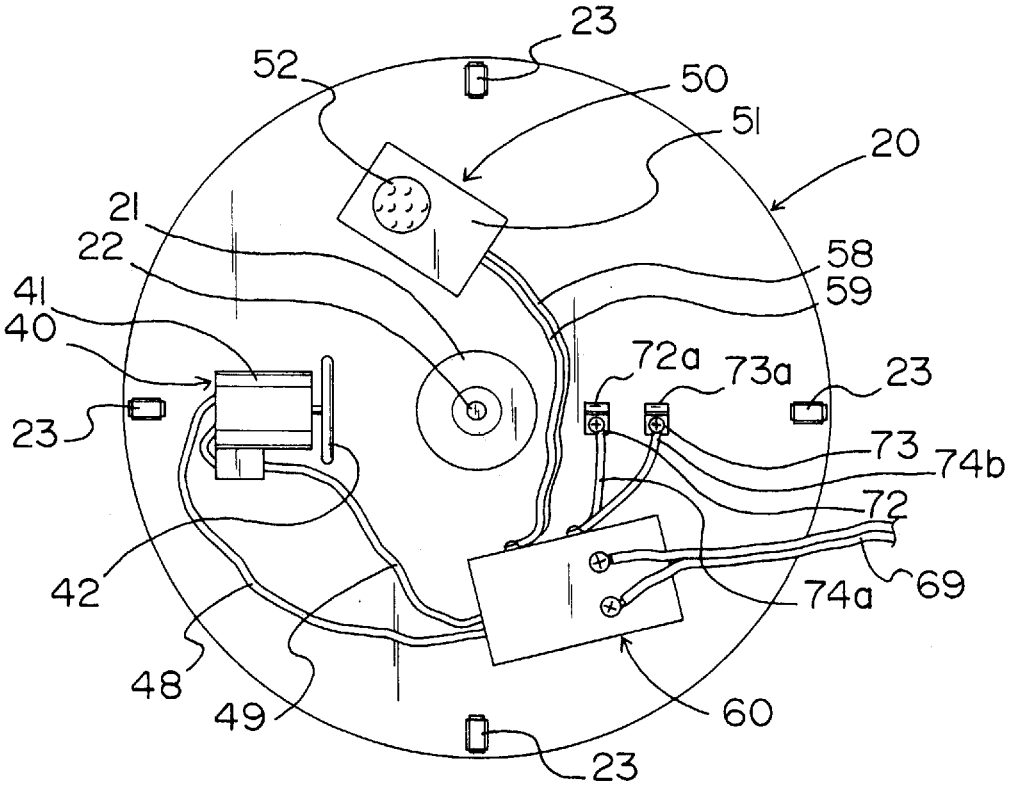
FIG. 4 is a top view of the stationary base member of the present invention.
Figure 5:
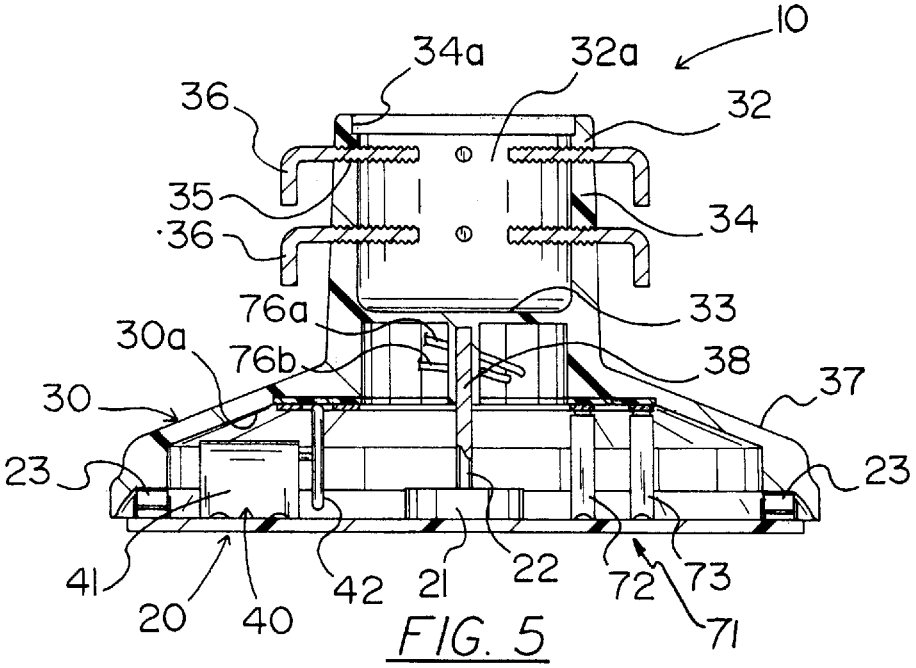
FIG. 5 is a cross sectional view taken along line 5—5 of FIG. 2.
Figure 6:
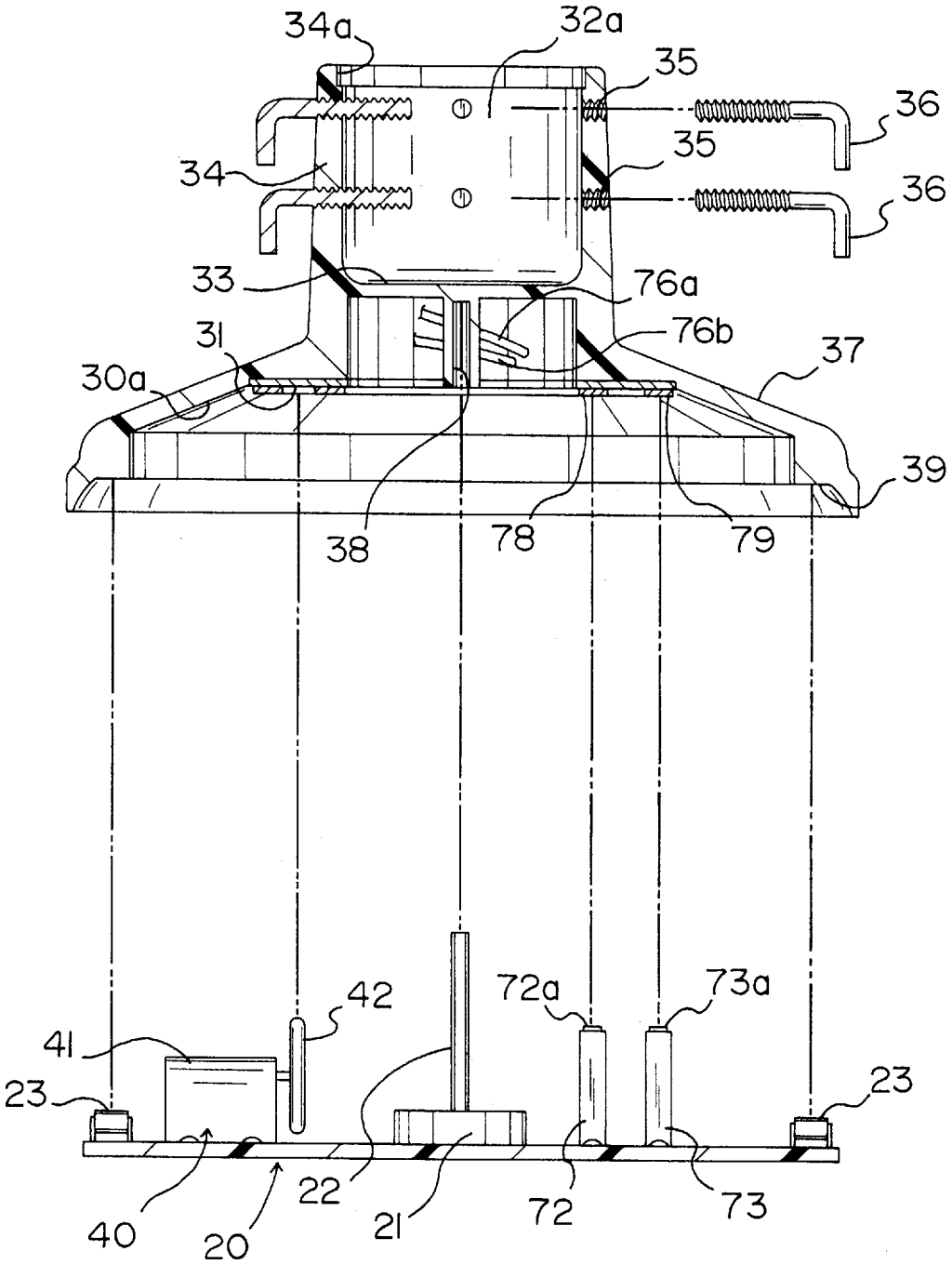
FIG. 6 is an exploded illustration of the stationary base member and the rotatable shell member of the present invention.
Figure 8:
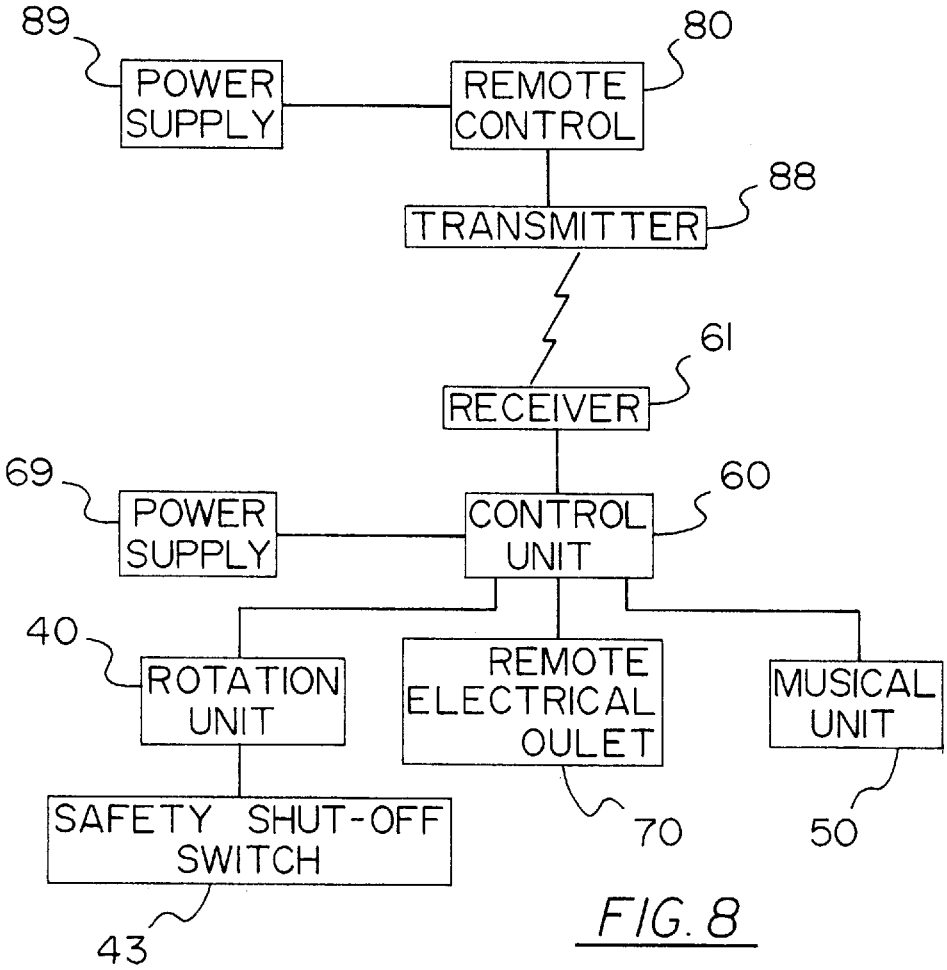
FIG. 8 is a schematic illustration of the components of the present invention.

As best illustrated in FIGS. 4 through 6, it can be shown that the rotation unit 40 comprises a drive motor 41 mounted on the stationary base member 20 and a frictional drive wheel 42 driven by the drive motor 41 wherein the frictional drive wheel 42 contacts the annular contact plate 31 provided on the inner surface 30*a* of the rotatable shell member 30 and rotates the rotatable shell member 30 relative to the stationary base member 20. The rotation unit 40 rotates the rotatable shell member 30 through 360 degrees. The rotation unit 40 includes a safety shut-off switch 43 which stops rotation of the rotatable shell member 30 if an object interferes with the tree or the rotatable shell member 30 itself while rotating. The drive motor 41 is pivotally mounted on the stationary base member 20 so as to enable the frictional drive wheel 42 to remain in continuous contact with the annular contact plate 31 as the rotatable shell member 30 rotates.

A bearing 21 is mounted on the stationary base member 20 and a shaft 22 projects upward from the bearing 21 wherein the shaft 22 fits within the shaft receiving hole 38 provided in the rotatable shell member 30. The stationary base member 20 includes a plurality of rollers 23 spaced along the perimeter of the stationary base member 20 for supporting the rotatable shell member 30 wherein the plurality of rollers 23 fit and roll within the circular roller groove 39 provided in the rotatable shell member 30.

The musical unit 50 (shown in FIG. 4) is provided for playing traditional Christmas carols such as "Jingle Bells," "Silent Night," "The Twelve Days of Christmas," etc. The musical unit 50 comprises a sound signal generating unit 51 mounted to the stationary base member for generating sound signals and a speaker 52 electrically connected to the sound signal generating unit 51 for converting the sound signals of the sound signal generating unit 51 into sound.

A control unit 60 (shown in FIG. 4) is provided for controlling the rotation unit 40, the musical unit 50, and the remote electrical outlet 70. The control unit 60 is mounted on the stationary base member 20 and is electrically connected to the rotation unit 40 by lead wires 48 and 49 and electrically connected to the musical unit 50 by lead wires 58 and 59. The control unit 60 includes a receiver 61.

A power supply 69 is provided for powering the control unit 60, the rotation unit 40, the musical unit 50, and the remote electrical outlet 70. The power supply 69 is 120 volts AC.

As best illustrated in FIGS. 3 through 6, it can be shown that the remote electrical outlet 70 comprises an electrical transfer means 71 for transferring electrical power from the stationary base member 20 to the rotatable shell member 30, a first pair of lead wires 74*a*, 74*b* electrically connected to the control unit 60 and the electrical transfer means 71, an electrical socket 75 adapted to accept an electrical plug (not shown), and a second pair of lead wires 76*a*, 76*b* electrically connected to the electrical transfer means 71 and the electrical socket 75. The electrical transfer means 71 includes a positive electrical probe 72 and a negative electrical probe 73 mounted on the stationary base member 20.

The positive electrical probe 72 has a positive electrical contact 72*a* and the negative electrical probe 73 has a negative electrical contact 73*a*. The positive electrical contact 72*a* is adapted for electrically contacting the positive electrical contact track 78 provided on the inner surface 30*a* of the rotatable shell member 30 and the negative electrical contact 73*a* is adapted for electrically contacting the negative electrical contact track 79 provided on the inner surface 30*a* of the rotatable shell member 30. As such, the positive electrical contact 72*a* is adapted to form an electrically conductive joint with the positive electrical contact track 78 and the negative electrical contact 73*a* is adapted to form an electrically conductive joint with the negative electrical contact track 79. The positive electrical contact 72*a* and the negative electrical contact 73*a* may each be a brush electrical contact or a roller electrical contact. The positive electrical probe 72 and the negative electrical probe 73 are mounted on the stationary base member 20 so as to enable them to remain in continuous contact with the positive electrical contact track 78 and the negative electrical contact track 79, respectively, as the rotatable shell member 30 rotates.

The first pair of lead wires 74*a*, 74*b* includes a first positive lead wire 74*a* and a first negative lead wire 74*b*. The first positive lead wire 74*a* is electrically connected to the control unit 60 and the positive electrical probe 72, and the first negative lead wire 74*b* is electrically connected to the control unit 60 and the negative electrical probe 73. The second pair of lead wires 76*a*, 76*b* includes a second positive lead wire 76*a* and a second negative lead wire 76*b*. The second positive lead wire 76*a* is electrically connected to the positive electrical contact track 78 and the electrical socket 75, and the second negative lead wire 76*b* is electrically connected to the negative electrical contact track 79 and the electrical socket 75.

Figure 7:
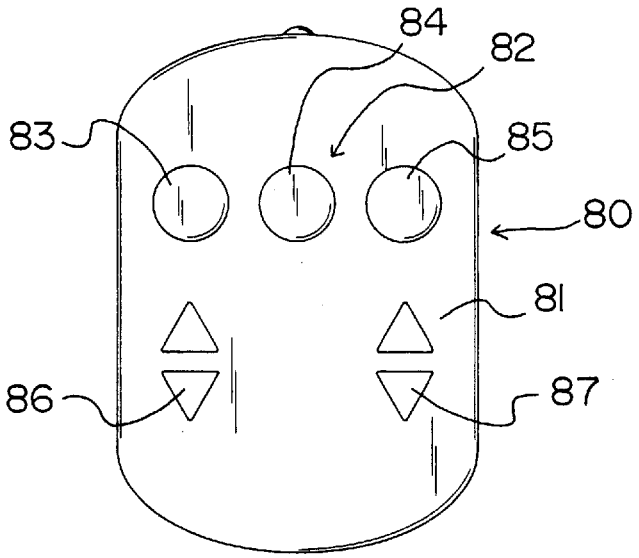
FIG. 7 is an illustration of the remote control of the present invention.

As best illustrated in FIG. 7, it can be shown that the remote control 80 comprises a housing 81 including functional control buttons 82 for controlling the operation of the Rotating Tree Stand 10. The functional control buttons 82 include a rotation control button 83, a remote electrical outlet control button 84, and a music control button 85 for controlling the respective features of the Rotating Tree Stand 10. A pair of rotation speed control buttons 86 are provided on the housing 81 for controlling the speed of rotation of the rotatable shell member 30. One of the pair of rotation speed control buttons 86 increases the speed of rotation and another of the pair of rotation speed control buttons 86 decreases the speed of rotation. A pair of music volume control buttons 87 are provided on the housing 81 for controlling the volume of the musical unit 50. One of the pair of music volume control buttons 87 increases the volume of the musical unit 50 and another of the pair of music volume control buttons 87 decreases the volume of the musical unit 50. A transmitter 88 is positioned within the housing 81 for transmitting a signal of functional commands to the receiver 61 of the control unit 60 (see FIG. 8). A remote control power supply 89 is provided for powering the remote control 80.

Figure 9:
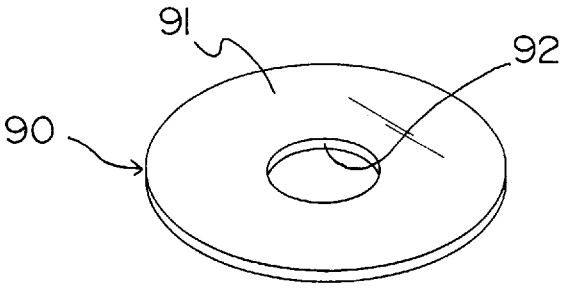
FIG. 9 is an illustration of the adapter plate for use the present invention.

As best illustrated in FIG. 9, it can be shown that an adapter plate 90 is provided for use in supporting an artificial Christmas tree (not shown) in the water-tight, circular cavity 32*a*. The adapter plate 90 comprises an annular ring 91 having a central hole 92 therethrough. The annular ring 91 fits within the lip 34*a* provided along the inner periphery of the circular wall 34 and the central hole 92 is adapted to receive a vertical support member (not shown) of the artificial Christmas tree.

In use, the trunk of a Christmas tree is positioned in the water-tight, circular cavity 32*a* of the tree support portion 32 of the rotatable shell member 30. The plurality of threaded clamping members 36 are threadingly fitted within the plurality of threaded holes 35 provided in the circular wall 34 of the tree support portion 32. The plurality of threaded clamping members 36 are threaded towards the trunk of the Christmas tree so as to secure the Christmas tree within the water-tight, circular cavity 32*a*.

By using the remote control 80, operation of the Rotating Tree Stand 10 can be controlled. Depressing the rotation control button 83 provided on the remote control 80 operates the rotation unit 40 which in turn rotates the rotatable shell member 30 relative to the stationary base member 20. The speed of rotation of the rotatable shell member 30 is controlled by depressing the pair of rotation speed control buttons 86. Depressing the music control button 85 provided on the remote control 80 operates the musical unit 50. The volume of the musical unit 50 is controlled by depressing the pair of music volume control buttons 87.

While decorating the Christmas tree, the electrical plug of an electrical adornment placed on the Christmas tree, such as a string of lights, is inserted into the electrical socket 75 of the remote electrical outlet 70 provided in the rotatable shell member 30. Depressing the remote electrical outlet control button 84 provided on the remote control 80 operates the remote electrical outlet 70 which in turn operates the string of lights or other electrical adornment placed on the Christmas tree.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotating tree stand comprising:

a stationary base member;

a rotatable shell member rotatingly coupled to said stationary base member whereby said rotatable shell member is rotatable relative to said stationary base member, said rotatable shell member shrouding said stationary base member and adapted to support said tree, said rotatable shell member having an inner surface;

a rotation unit, said rotation unit being for rotating said rotatable shell member relative to said stationary base member, said rotation unit shrouded by said rotatable shell member, said rotation unit rotating said rotatable shell member through 360 degrees;

a musical unit for playing songs, said musical unit shrouded by said rotatable shell member;

a remote electrical outlet provided in said rotatable shell member;

a control unit electrically connected to said rotation unit for controlling said rotation unit, said control unit electrically connected to said musical unit for controlling said musical unit, said control unit electrically connected to said remote electrical outlet for controlling said remote electrical outlet, said control unit shrouded by said rotatable shell member;

a power supply for powering said control unit;

wherein said rotatable shell member includes a tree support portion and a shroud portion, said shroud portion extending radially from said tree support portion;

wherein said tree support portion includes a base, a circular wall extending upward from said base, said base and said circular wall defining a circular cavity adapted to receive said tree, said circular wall having a plurality of threaded holes therethrough, and a plurality of threaded clamping members threadingly fitted within said plurality of threaded holes, whereby said plurality of threaded clamping members are threaded towards said tree to secure said tree within said circular cavity;

wherein said rotation unit includes a drive motor, said drive motor being mounted on said stationary base member, and a frictional drive wheel, said frictional drive wheel being driven by said drive motor, said frictional drive wheel being smooth and contacting said inner surface of said rotatable shell member, said frictional drive wheel being for rotating said rotatable shell member relative to said stationary base member in a manner permitting direct frictional abutment of said drive wheel relative to said inner surface of said rotatable shell member, and a safety shut-off switch, said safety shut-off switch being for stopping rotation of said rotatable shell member if said rotatable shell member is obstructed while rotating;

wherein said musical unit includes a sound signal generating unit, said sound signal generating unit being mounted to said stationary base member for generating sound signals, and a speaker, said speaker being electrically connected to said sound signal generating unit for converting said sound signals of said sound signal generating unit into sound;

wherein said remote electrical outlet includes a positive electrical contact track provided on said inner surface of said rotatable shell member, a negative electrical contact track provided on said inner surface of said rotatable shell member, said positive electrical contact track and said negative electrical contact track concentrically spaced, a positive electrical probe mounted on said stationary base member, said positive electrical probe having a positive electrical contact adapted for electrically contacting said positive electrical contact track, a negative electrical probe mounted on said stationary base member, said negative electrical probe having a negative electrical contact adapted for electrically contacting said negative electrical contact track, said positive electrical contact and said negative electrical contact transferring electrical power from said stationary base member to said rotatable shell member, a first pair of lead wires including a first positive lead wire and a first negative lead wire, said first positive lead wire electrically connected to said control unit and said positive electrical probe, and said first negative lead wire electrically connected to said control unit and said negative electrical probe, an electrical socket mounted in said rotatable shell member, said electrical socket adapted to accept an electrical plug, and a second pair of lead wires including a second positive lead wire and a second negative lead wire, said second positive lead wire electrically connected to said positive electrical contact track and said electrical socket, and said second negative lead wire electrically connected to said negative electrical contact track and said electrical socket;

a remote control, said remote control being for controlling operation of said rotating tree stand; and wherein said remote control includes a rotation control button, said rotation control button being for controlling said rotation unit, a remote electrical outlet control button, said remote electrical outlet control button being for controlling said remote electrical outlet, a music control button, said music control button being for controlling said musical unit, a rotation speed control button, said rotation speed control button being for controlling the speed of rotation of said rotatable shell member, and a music volume control button, said music volume control button being for controlling the volume of said musical unit.

* * * * *